US005228248A

United States Patent [19]

Haddock

[11] Patent Number: 5,228,248

[45] Date of Patent: Jul. 20, 1993

[54] MOUNTING DEVICE FOR BUILDING STRUCTURES

[76] Inventor: Robert M. M. Haddock, 8655 Table Butte Rd., Colorado Springs, Colo. 80908

[21] Appl. No.: 912,845

[22] Filed: Jul. 13, 1992

[51] Int. Cl.[5] ..... E04D 13/10

[52] U.S. Cl. ..... 52/25; 52/545

[58] Field of Search ..... 52/24, 25, 26, 528, 52/536, 538, 545

[56] References Cited

U.S. PATENT DOCUMENTS

| | | | |
|---|---|---|---|
| 42,992 | 5/1864 | Howe . | |
| 97,316 | 11/1869 | Rogers . | |
| 106,580 | 8/1870 | Hathorn . | |
| 250,580 | 12/1881 | Rogers . | |
| 459,876 | 9/1891 | Powers . | |
| 529,774 | 11/1894 | Baird | 52/25 |
| 602,983 | 4/1898 | Folsom . | |
| 756,884 | 4/1904 | Parry . | |
| 1,054,091 | 2/1913 | Darnall | 52/25 |
| 1,230,363 | 6/1917 | Baird | 52/25 |
| 2,079,768 | 5/1937 | Levow | 52/25 |
| 2,201,320 | 5/1940 | Place | 52/25 |
| 4,141,182 | 2/1979 | McMullen . | |
| 5,152,107 | 10/1992 | Strickert . | |

FOREIGN PATENT DOCUMENTS

| | | | |
|---|---|---|---|
| 1215468 | 4/1960 | France | 52/24 |
| 204783 | 5/1939 | Switzerland | 52/24 |

*Primary Examiner*—Henry E. Raduazo
*Assistant Examiner*—Christopher T. Kent
*Attorney, Agent, or Firm*—Sheridan, Ross & McIntosh

[57] ABSTRACT

An apparatus (10) for controlling the movement of snow and/or ice along/across selected areas of a roof (16), such as a metal, raised seam roof, is disclosed. The apparatus (10) comprises clamps (12) interconnected by at least one cross-member (18). The clamps (12) frictionally engage an external surface of a roof ridge (14) such that the clamps (12) are secured to the roof (16) without piercing the roof (16). The cross-member (18) can be straight or bent and a mechanism can be provided for adjusting the height of at least a portion of the cross-member (18) over the roof (16).

22 Claims, 9 Drawing Sheets

MOUNTING DEVICE FOR BUILDING STRUCTURES

FIELD OF THE INVENTION

The present invention generally relates to devices for interconnecting a structure/member to a building and, in one application, to such a device which is detachably connected to raised portions of a metal roofing surface to allow for the control of the sliding of snow and/or ice down the pitch of the roof over a predetermined area.

BACKGROUND OF THE INVENTION

Sliding snow and/or ice from roofs can be hazardous to people, the surrounding landscape, property, and building components. For example, snow or ice sliding from a roof above an entryway may injure passers-by. Similarly, falling snow or ice can do damage to landscape features, such as shrubs, and property or building components, including automobiles or lower roofing portions. In addition, sliding snow or ice can shear off antennas, gutters or other components attached to a building roof or wall, thereby potentially causing a leak. The problem of sliding snow or ice is particularly experienced in connection with metal roofs, including raised seam roofs (e.g., standing seam), where there is relatively little friction between the roof and the snow or ice. As used herein, the term "raised seam roofs" includes roofs formed by a series of panels interconnected to define longitudinal, raised portions. It may therefore be desirable to provide a guard suitable for controlling movement of snow and/or ice across/along selected areas of such metal roofs.

Snow guard devices were initially developed for use on tile and shingle roofs. In one type of configuration for use on such roofs, an L-shaped brace has one leg which is fastened to the roof and another leg which projects upwardly from the roof. The fastening leg is typically nailed or screwed into the roof beneath a shingle or tile. By positioning and attaching a plurality of these braces to the roof in substantially linear fashion, linear bars may be positioned within/through one or more receiving areas of the respective upwardly projecting legs to provide a fence-like configuration for snow and/or ice retention. U.S. Pat. No. 97,316 to Rogers, issued Nov. 30, 1869, U.S. Pat. No. 106,580 to Hathorn, issued Aug. 23, 1870, U.S. Pat. No. 250,580 to Rogers, issued Dec. 6, 1881, and U.S. Pat. No. 756,884 to Parry, issued Apr. 12, 1904, are generally representative of this type of device.

A device which employs a similar structure to the above but which does not require the individual braces to actually be affixed to the roof is presented in U.S. Pat. No. 42,972 to Howe, issued May 31, 1864. In this case, the plurality of braces for receiving the linear bars are positioned on opposite sides of the roof and are interconnected by a harness assembly. By positioning the brace/bar assemblies on both sides of the roof, the snow retention device is presumably held in position.

Other snow retention devices for shingle or tile roofs have utilized a unitary construction For instance, U.S. Pat. No. 459,876 to Powers, issued Sep. 22, 1891, discloses a snow guard having two, laterally displaced spikes which are driven into the roofing surface, with the interconnecting portion of the spikes having a generally V-shaped configuration which extends downwardly toward the roofing surface. U.S. Pat. No. 602,983 to Folsom, issued Apr. 26, 1898, discloses a device used with a tiled roofing surface having grooves formed such that the spikes or leg portions of the device may be positioned therein. An interconnecting portion between the spikes or legs in this instance incorporates a loop-like configuration.

Another snow retention device is the SNOW-JAX TM snow guard which is believed to be the subject of U.S. Pat. No. 4,141,182 to McMullen, issued Feb. 27, 1979. This device comprises a plastic barrier having a generally L-shaped cross-section. The device can be installed by smearing the underside of the device with silicon intended to provide a weather seal, positioning the device against the roof surface, and attaching the device to the roof with screws such that the screws penetrate the roofing surface and become anchored into an underlying structural member. An adhesive may be used in place of the screws where desired.

The ThyCurb division of Thybar Corporation has also marketed a snow guard device for use on trapezoidal-type, standing seam roofs having 24 inch wide panels. The device comprises a horizontal steel member which spans one panel width. The horizontal member is fixedly attached at ends thereof to mounting members which straddle the trapezoidal panel ribs. These mounting members are fastened to the panel ribs by screws.

There are a number of problems generally associated with one or more of the snow guard devices described above. First, such devices may cause the roof to leak. Many of the devices described above are attached to the roof by a screw, nail or other fastener which pierces the roofing surface. Such piercing of the roof can lead to undesired leakage due to inadequate sealing or shearing of the fastener by the forces exerted thereon by sliding snow and/or ice. In an attempt to prevent leakage, sealants and/or gaskets are often applied around the holes pierced through the roofing surface. However, these measures complicate installation and may not fully prevent leaks. Known alternative methods for attachment of snow guard devices to roofs (e.g., adhesive bonding), may fail to provide secure attachment, particularly where the device is applied to a smooth, non-porous roofing material such as metal.

Many known snow guard devices can also cause undesired pinning of the roofing materials. Metal roofing sheets are often designed to be moveable so as to accommodate normal thermal expansions and contractions. Where snow guard devices such as described above are attached to the roof by a screw, nail or the like, which pierces the roofing surface and is anchored into an underlying structural member or deck, the designed thermal movement characteristics of the roof can be compromised, thereby adversely affecting the roof's performance.

The types of snow guard devices described above are also generally not readily adaptable for use in a broad range of raised seam roofing applications. Some of the devices described above are not intended for raised seam roofing applications at all but, rather, are primarily for use on shingled or other non-raised seam roofs. Other known devices are designed for use on raised seam roofs having a particular panel width and seam profile and cannot be easily adjusted for use in connection with panels of differing widths or seams of various profiles. Moreover, some known devices are designed to be permanently connected to a roof such that the device cannot be easily repositioned as may be desired.

In addition, known snow guard devices generally comprise a snow blocking element having a height, relative to the roof surface, which is unadjustable, difficult to adjust, or adjustable only between a small range of predetermined positions. Accordingly, the user's ability to adjust such devices, as may be desired to suit particular conditions with respect to snowfall, drifting and the like, is limited.

SUMMARY OF THE INVENTION

According to one aspect of the present invention, an apparatus for controlling movement of snow and/or ice across/along selected areas of a sloped roofing surface is provided which does not require a piercing engagement with the underlying roofing structure for attachment thereto. The apparatus is particularly suitable for use on roofing surfaces having a plurality of longitudinally extending raised portions, extending from an elevated portion of the surface to a lower portion thereof, and separated by base portions, wherein the raised portions are positioned above a reference plane a greater distance than the base portions. This roofing configuration may be provided, for instance, by a plurality of panels which are interconnected utilizing standing seams. However, it will be appreciated that only two raised portions on the roofing surface are required for installation of the device in accordance with this aspect of the present invention.

One embodiment of an apparatus in accordance with the non-piercing aspect of the present invention includes a first clamp for detachably engaging a first raised portion on the roofing surface and a second clamp for detachably engaging a second raised portion on the roofing surface. Each of the clamps comprises a body having a longitudinal cavity for receiving a raised portion and a mechanism for frictionally engaging an external surface of the associated raised portion. For example, such frictional engagement can be accomplished by friction fitting the slot to the raised portion and/or by providing a contact member (e.g., a blunt-nosed screw) which is extendible from a wall of said cavity to frictionally contact the raised portion. Thus, the clamps may engage the raised portions without piercing the same, thereby reducing the likelihood of leakage and eliminating any attachment holes should the user desire to relocate or remove the device at a later date. In addition, the apparatus includes a cross-member which extends between and is interconnectable with the clamps and which is positioned above the underlying base portion of the roofing surface which extends between such raised portions.

Under some circumstances it may be desirable to provide for an adjustment of the distance between at least a portion of the cross-member and the corresponding base portion (i.e., that base portion(s) which underlies the cross-member). The clamps may include one or more features to provide for this type of adjustment. For instance, in one embodiment a separate extension may be detachably connected to each of the clamps such that a cross-member (e.g., a substantially straight rod) may be positioned within the extensions to extend between the associated raised portions. By varying the height of the extensions, the distance between the cross-member and its associated base portion(s) may be modified. In another embodiment the cross-member may include a portion which is offset from the end portions which engage the clamps. Consequently, the cross-member may be pivoted about the end portions within the clamps, thereby varying the distance between the intermediate portion and the corresponding base portion(s).

The clamps associated with this non-piercing aspect of the present invention may also incorporate a variety of features to enhance the versatility of the present invention. For instance, the cross-members may be detachably connected to the clamps such that the present invention may be used on a variety of panel-width roofing surfaces (e.g., a variety of lengths of cross-members may be provided to account for different distances between adjacent raised portions on different roofing surfaces). Moreover, the clamps may each include two openings of different orientations such that one of the openings will receive the cross-member when the clamp assumes a first orientation on a given raised portion, whereas the other opening will receive the cross-member when the clamp assumes a second orientation on a given raised portion. For instance, depending upon the configuration of the raised portion, it may be necessary to mount the clamp thereon in an orientation in which the cavity projects in a direction which is substantially parallel to the base portions (e.g., in the instance where the raised portion has an inverted L-shaped configuration which is one type of standing seam formed when interconnecting panel sections), or it may be necessary to mount the clamp thereon in an orientation in which the cavity projects downwardly toward the base portion through the raised portion (e.g., where the raised portion is a substantially vertical projection from the roof, which is another type of standing seam formed when interconnecting panel sections).

According to another aspect of the invention, an apparatus is provided for controlling movement of snow and/or ice across/along selected areas of a sloped roofing surface in which the distance between portions of the apparatus and the roofing surface may be adjusted in a desirable manner. The apparatus is particularly suited for use on roofing surfaces having the above-described plurality of longitudinally extending raised portions (e.g., a standing seam panel interconnection configuration), but again only requires two displaced raised portions for installation.

One embodiment of an apparatus in accordance with the height adjustment aspect of the present invention comprises a first clamp for engaging a first raised portion on the sloped roofing surface and a second clamp for engaging a second raised portion on the sloped roofing surface, wherein each of the clamps includes a longitudinal cavity for receiving the associated raised portion. The apparatus further includes a cross-member supported by and extending between first and second receiving portions of the first and second clamps, respectively. Moreover, a mechanism is provided for adjusting the distance between at least a portion of the cross-member and the underlying roofing surface while the cross-member is retained within the first and second receiving portions.

Although the cross-member may assume a variety of configurations, the configuration of such may be utilized to provide for a simple and effective means for providing the described height adjustment. More particularly, in one embodiment the cross-member has first and second end portions which are positioned in the first and second receiving portions of the first and second clamps, respectively. An intermediate portion extends between and interconnects these end portions and is also offset therefrom. Consequently, by rotating the first and second end portions within the first and second receiving portions, respectively, the intermediate portion pivots about such receiving portions to vary the distance between such intermediate portion and the underlying roofing surface. The cross-member may then be secured in the desired position, such as by utilizing a set screw. In the case where three clamps are installed on three of such raised portions such that two of the described cross-members are used (i.e., one cross-member between each pair of adjacent clamps), this single set screw may be used to fix the position of both of the cross-members which engage/interact the intermediate clamp.

Although the above-described types of clamps and the various cross-members are desirable for the controlled snow and/or ice sliding application, it can be appreciated that the same or structurally similar clamps may be utilized in a variety of other applications, including where it may be desirable to have a clamp which may be detachably connected to a metal surface without penetrating/piercing such surface. In this aspect of the present invention, an apparatus for securing a structural member to a metal surface (e.g., sidewall, roof) is provided. The metal surface includes a raised portion which is positioned above a reference plane a greater distance than other portions of the surface. In this regard, a clamp engages the raised portion and has a body with a longitudinal cavity therein for receiving such raised portion, as well as a mechanism for frictionally engaging an external surface of the raised portion to secure the clamp to the raised portion. The apparatus further includes at least one mounting member positioned within the body and adapted for interconnecting the structural member to the body. Consequently, the clamp may be used to mount various assemblies/components to metal surfaces, such as mounting catwalks and/or ventilation equipment onto a metal roofing surface formed by a plurality of interconnected panels, with the interconnections forming a standing seam, as well as mounting a sign(s) onto a sidewall of a building having an appropriate raised portion.

BRIEF DESCRIPTION OF THE DRAWINGS

For a more complete understanding of the present invention and further advantages thereof, reference is now made to the following Detailed Description taken in conjunction with the Drawings, in which.

DETAILED DESCRIPTION

The present invention will be described with reference to the accompanying drawings which assist in illustrating the pertinent features thereof. In this regard, the present invention is generally a device which may be positioned upon a building surface (e.g., roof, sidewall) in a desirable manner to provide for a variety of applications, one of which is to control the movement of snow and/or ice down/along a predetermined sloped portion of a roofing surface. In this regard, in one aspect the present invention may be detachably connected to laterally displaced raised portions of the roof (e.g., standing seams in the case of interconnected metal panel sections) without piercing such raised portions, thereby reducing the potential for leaks. A member may then extend between such raised portions to control the movement of snow and/or ice down the roofing surface between such raised portions in a desirable manner. In another aspect, the present invention may be positioned on the described raised portions and the position of the member extending therebetween may be adjusted. Consequently, the distance between at least a portion of such member and its underlying roofing portion may be adjusted to compensate, for instance, for varying environmental conditions and/or desired performance criteria relating to the described controlling of the movement of snow and/or ice down the roofing surface.

Figure 1:
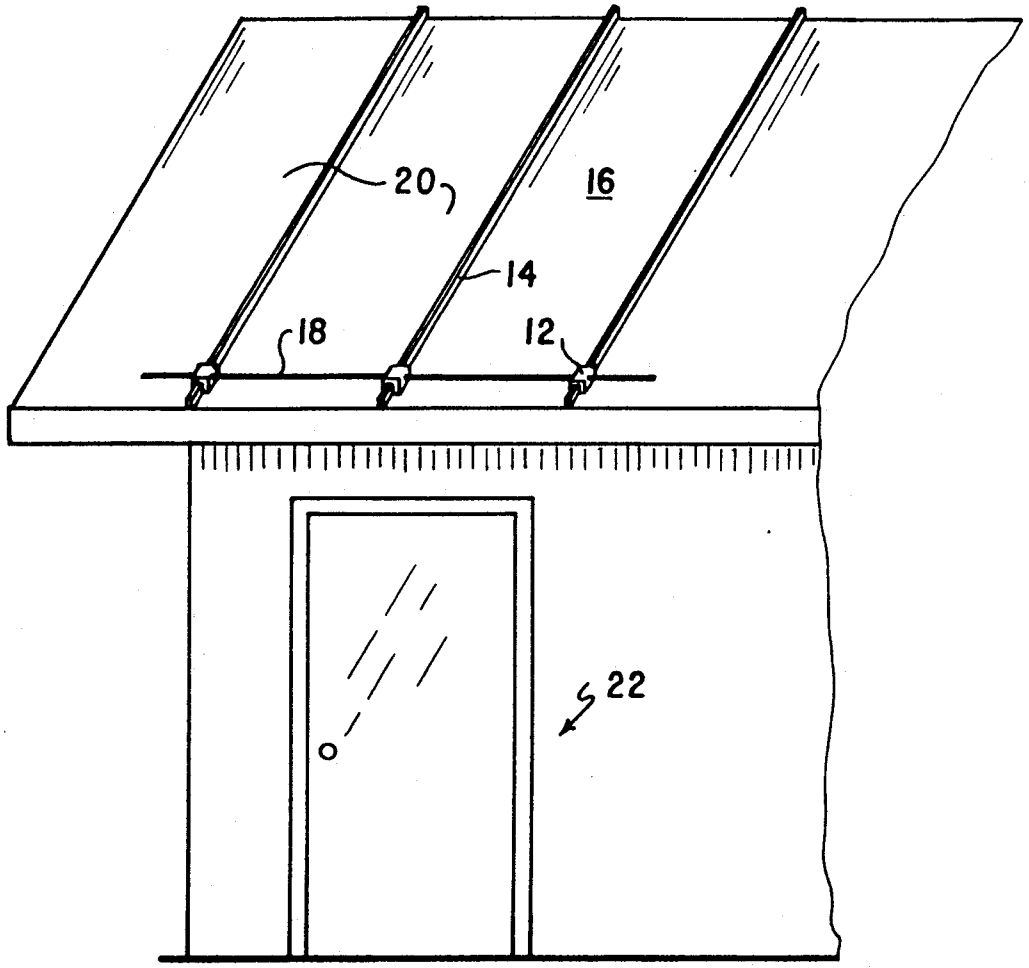
FIG. 1 is a perspective view of an apparatus constructed in accordance with one embodiment of the present invention.
Figure 2A:
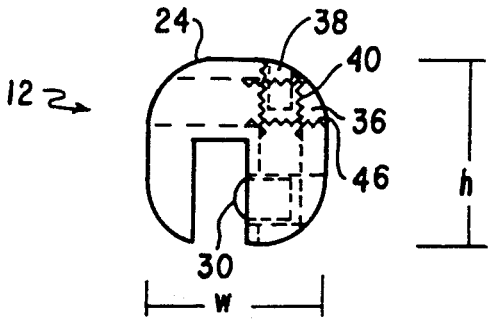
FIG. 2*a* is a front view of a clamp constructed in accordance with one embodiment the present invention.
Figure 2B:
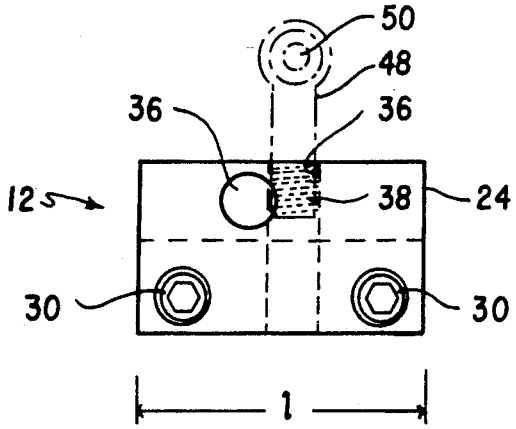
FIG. 2*b* is a right side view of the clamp of FIG. 2*a;*
Figure 2C:
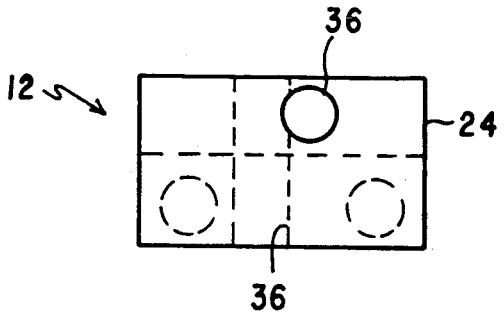
FIG. 2*c* is a left side view of the clamp of FIG. 2*a;*
Figure 2D:
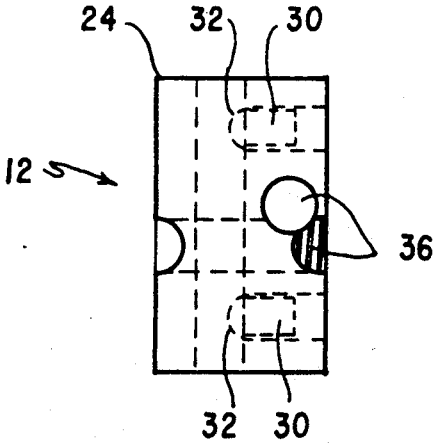
FIG. 2*d* is a top view of the clamp of FIG. 2*a;*
Figure 2E:
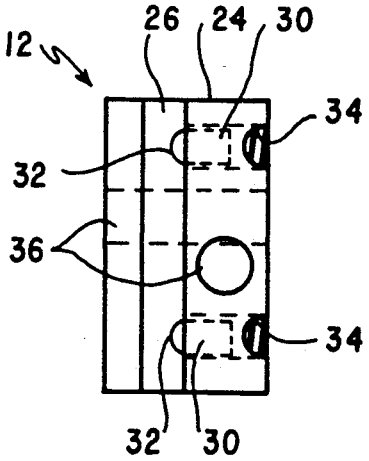
FIG. 2*e* is a bottom view of the clamp of FIG. 2*a;*

As noted above, in one application the present invention provides for a control of the movement of snow and/or ice (e.g., retardation/termination of movement) along a predetermined sloped portion of a roofing surface. Referring to FIG. 1, an apparatus constructed in accordance with one embodiment of the present invention is identified by the reference numeral 10 as used in this particular application. Generally, the apparatus 10 includes at least two clamps 12 (three shown and described in more detail below) for attachment to ridges 14 of a roof 16 and at least one cross-member 18 spanning between adjacent clamps 12. The cross-member 18 controls the movement of snow and/or ice along its respective underlying portion of the roof. More particularly, the movement of snow and/or ice positioned above and aligned with the cross-member 18 is controlled in that the movement of such snow or ice past the cross-member 18 toward the eaves 17 is retarded and/or terminated. As can be appreciated, this may be desirable in a number of circumstances, such as when a sloping portion of the roof 16 is positioned above an entryway 22.

One embodiment of a clamp 12 which may be used with the apparatus 10 of FIG. 1 is more particularly illustrated in FIGS. *2a–e*. Initially, the body 24 of the clamp 12 may be formed from materials such as various metals, ceramics or plastics based upon, for instance, the particular application. In this regard, the illustrated clamp 12 is formed from aluminum which provides sufficient load-bearing capability and is also non-corrodible, thus enhancing durability and appearance. As can be appreciated, the aluminum can be anodized to further enhance the appearance of the apparatus 10. Other metals may be stainless, zinc, copper or brass alloys.

The body 24 of the clamp 12 generally has a "C" shaped cross-section defined by a longitudinal slot 26 which receives the ridge 14 therein. The edges of the body 24 may be chamfered or rounded if desired to reduce material requirements and enhance the appearance of the apparatus 10. Moreover, the dimensions of the clamp 12 can be varied and may be selected to suit particular applications. For example, the depth, width or shape of the slot 26 can be selected to closely match the profile of the ridges 14 and/or to accommodate for ridges 14 within a predefined range of widths. Furthermore, the body 24 of the clamp 12 can be dimensioned to allow the cross-member 18 to be positioned a desired distance above the surface of the roof 16. In the illustrated application, the clamp 12 has a width, w, of approximately $1\frac{1}{4}$ inches; a height, h, of approximately $1\frac{1}{4}$ inches; and a length, 1, of about 2 inches. Moreover, the slot is about $\frac{3}{4}$ inches deep and $\frac{3}{8}$ inches across. These dimensions have been found suitable for an appropriate range of raised seam roofing applications.

It is an advantage of the present invention that the clamp 12 can be attached to the roof 16 in a manner such that the roof 16 is not pierced. In this regard, the clamp 12 can be secured to the roof 16 by frictionally engaging external surfaces of the ridge 14 rather than by using a screw, nail or the like which penetrates through the roofing material. For example, this frictional engagement can be accomplished by friction fitting the slot 26 to the ridge 14 and/or by extending at least one protrusion from a wall of the slot 26, after the body 24 has been positioned on the ridge 14, such that the protrusion frictionally engages the ridge 14. In the illustrated embodiment, a pair of set screws 30 are threadably extendible from a wall of the slot 26 and are utilized to engage the ridge 14. The illustrated screws 30, which can have blunt or rounded, non-piercing ends 32, frictionally engage the ridge 14, such as by dimpling without penetrating the same. Access to the screws 30 is provided through threaded bores 34. Conveniently, the screws 30 can be provided with an allen head dimensioned so that the screw can be hidden within body 24 and yet can be easily adjusted. Based upon this manner of installation, it will be appreciated that the clamp 12 can be easily repositioned on the ridge 14 as may be desired without leaving holes in the ridge 14 which could cause leakage.

Any suitable means may be utilized for interconnecting clamp 12 and cross-member 18. The illustrated clamp 12 is provided with openings 36, 42 dimensioned so as to be capable of slidably receiving the cross-member 18 therein when in different positions upon the ridge 14. In this regard and as illustrated in FIG. *3a*, in one particular type of standing seam configuration (only generally illustrated) to define the ridge 14 the cavity 26 of the clamp 12 extends in a generally downward direction. A common raised seam profile of this type is illustrated in FIG. *3b*. The cross-member 18 and clamp 12 can thus be interconnected by sliding the cross-member 18 through the opening 36 and securing the cross-member 18 to the clamp 12 with a set screw 38 or the like. The set screw 38 is threaded into a threaded bore 40 which intersects the opening 36 such that the screw 38 contacts the cross-member 18 so as to secure the positioning of the cross-member 18 in the clamp 12. If desired, an eye bolt 48, shown in phantom in FIG. *2b*, may be provided in place of the set screw 38, to allow an additional cross-member 50 (phantom) to be provided higher above the panels 20. Alternatively, only the cross-member 50 need be utilized and such may be positioned through the eye bolt 48. In this case, it can be appreciated that by varying the length of the eye bolt 48, the distance between the panels 20 and the cross-member 50 may be adjusted which may be desirable under certain circumstances. As an alternative to using the eye bolt 48, a cross-member (not shown) of a desired configuration may be directly attached to the upper surface of the clamp 12 in a suitable manner (e.g., via appropriate threaded connections within the body 24), such as in the case of the cross-members 82', 82'' illustrated in use with the apparatus 52 of FIGS. *5b* and/or *5c*.

The clamp 12 may also assume the orientation illustrated in FIG. *4a* in which the cavity 26 projects in a substantially parallel direction to that of the panels 12. This is utilized in conjunction with another particular type of standing seam configuration which is only generally illustrated in FIG. *4a*. A common raised seam profile of this type is illustrated in FIG. *4b*. In this instance, the cross-member 18 is received within the top-to-bottom opening 42 and may be retained therein by a set screw (not shown) positioned within an end portion of the bore 46. It should be noted that bore 40 forms a portion of opening 42. Similarly, bore 46 forms a portion of opening 36. Thus, bore 40/opening 42 and bore 46/opening 36 can be partially threaded as shown. The above-described eye bolt 48 may also be positioned within the bore 46 as in the case of the above-described vertical orientation of the clamp 12 noted above to provide for the discussed alternatives (not shown).

Figure 3A:
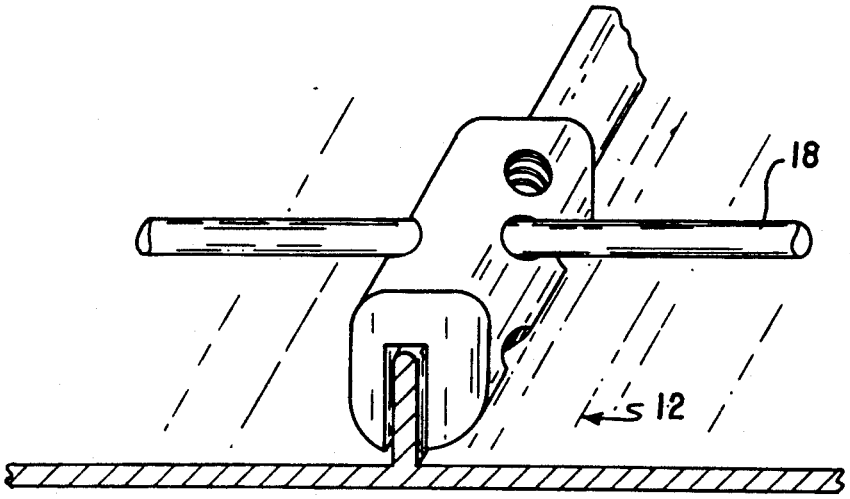
FIG. 3*a* shows the apparatus of FIG. 1 installed in a generally vertical configuration.
Figure 4A:
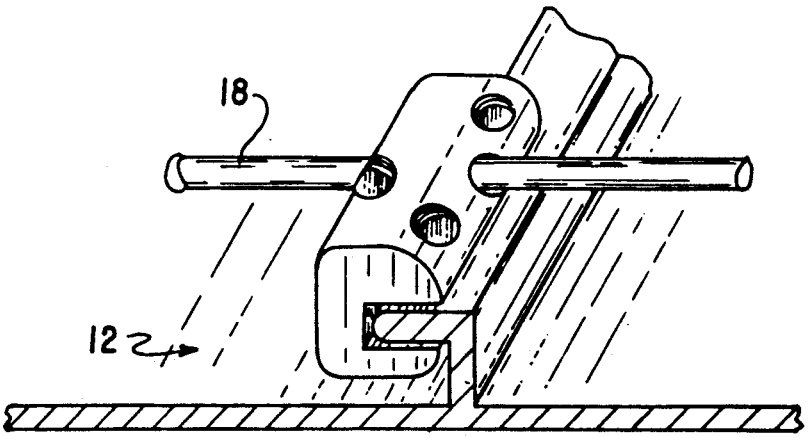
FIG. 4*a* shows the apparatus of FIG. 1 installed in a generally horizontal configuration.
Figure 3B:
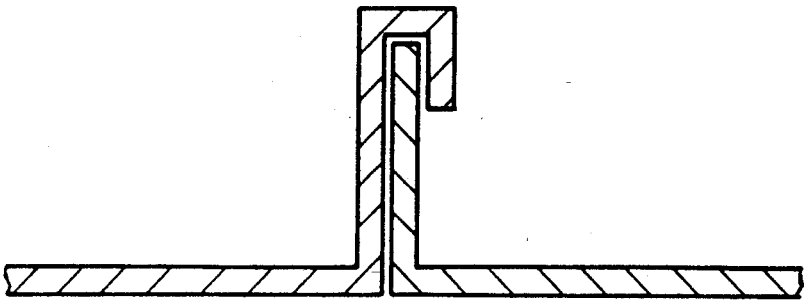
FIG. 3*b* shows a particular raised seam profile on which the apparatus of FIG. 1 may be installed in a generally vertical configuration.
Figure 4B:
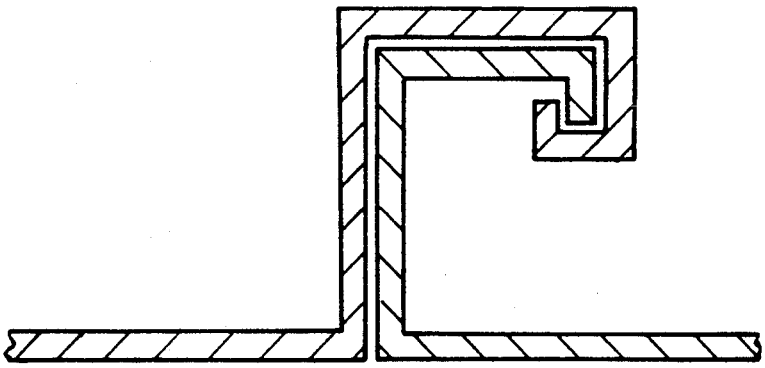
FIG. 4*b* shows a particular raised seam profile on which the apparatus of FIG. may be installed in a generally horizontal configuration.

The cross-member 18 can be formed from any suitable material including various metals, ceramics or plastics. The illustrated cross-member 18 is a solid rod formed from aluminum which can be anodized if desired. Other metals may be stainless, zinc, copper or brass alloys. Although various cross-member 18 thickness/diameter may be utilized in accordance with the present invention, the illustrated member has a diameter of about $\frac{3}{8}$ inches. Accordingly, bore 40/opening 42 and bore 46/opening 36 can have diameters of about $\frac{3}{8}$ inches or slightly more than $\frac{3}{8}$ inches so that the cross-member 18 can be slidably received therethrough. The length of the cross-member 18 can be selected, for example, based on the width of the panels, the width of the area across which snow or ice slide protection is desired, or other factors (e.g., a single cross-member 18 may extend through a plurality of clamp 12, or an individual cross-member 18 may extend only between two clamps 12). In this regard, it is an advantage of the present invention that the apparatus 10 is easily adaptable for use in connection with a variety of roofing applications involving panels of various widths. The cross-member 18 can be received within the body 24 of the clamps 12 in the described manner, can be generally straight as shown in FIGS. 3*a* and 4*a*, or can be bent as described below in connection with a further embodiment of the invention so as to allow adjustment of the height of the cross-member 18 over the roof 16. Moreover, a cross-member (not shown) for use alone or in combination with the cross-member 18 may be provided and may be secured to the clamp 12 by utilizing the threaded bored openings 36/46 or 36/40, or alternatively by field drilling and/or tapping additional holes in the clamp 12. This cross-member may consist of a variety of geometries other than the rod of the cross-member 18, such as the "L" and "Z" shaped configurations illustrated in FIGS. 5*b* and 5*c* for cross-members 82' and 82", respectively.

Figure 5A:
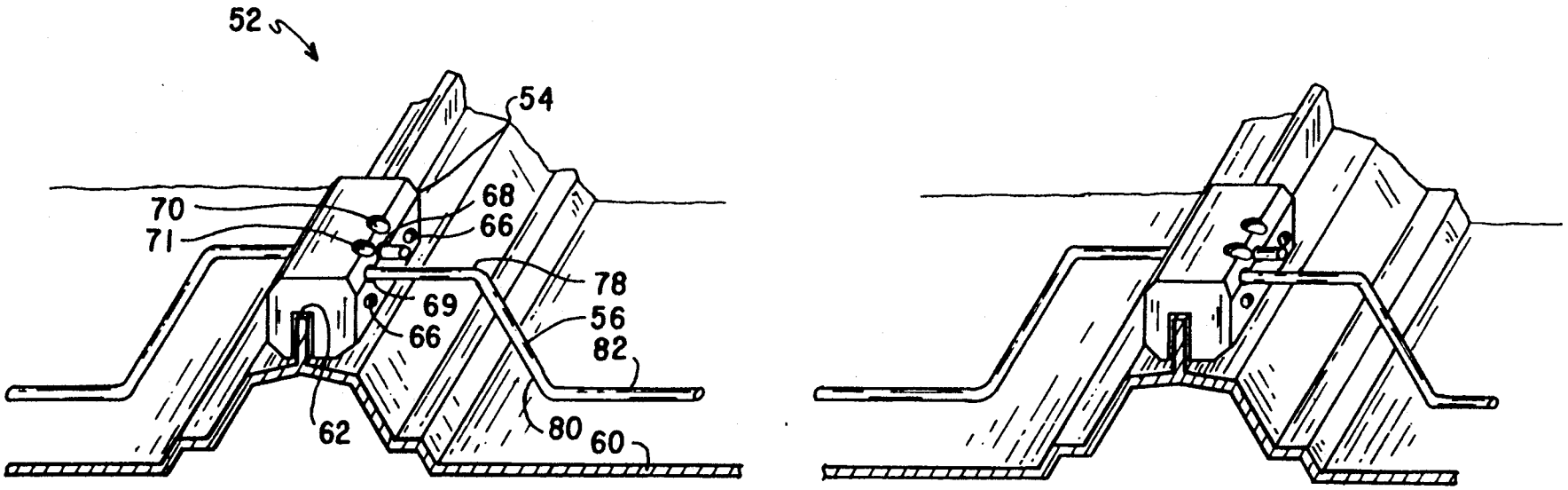
FIG. 5*a* is a perspective view of an apparatus constructed in accordance with an alternative embodiment of the present invention.
Figure 5B:
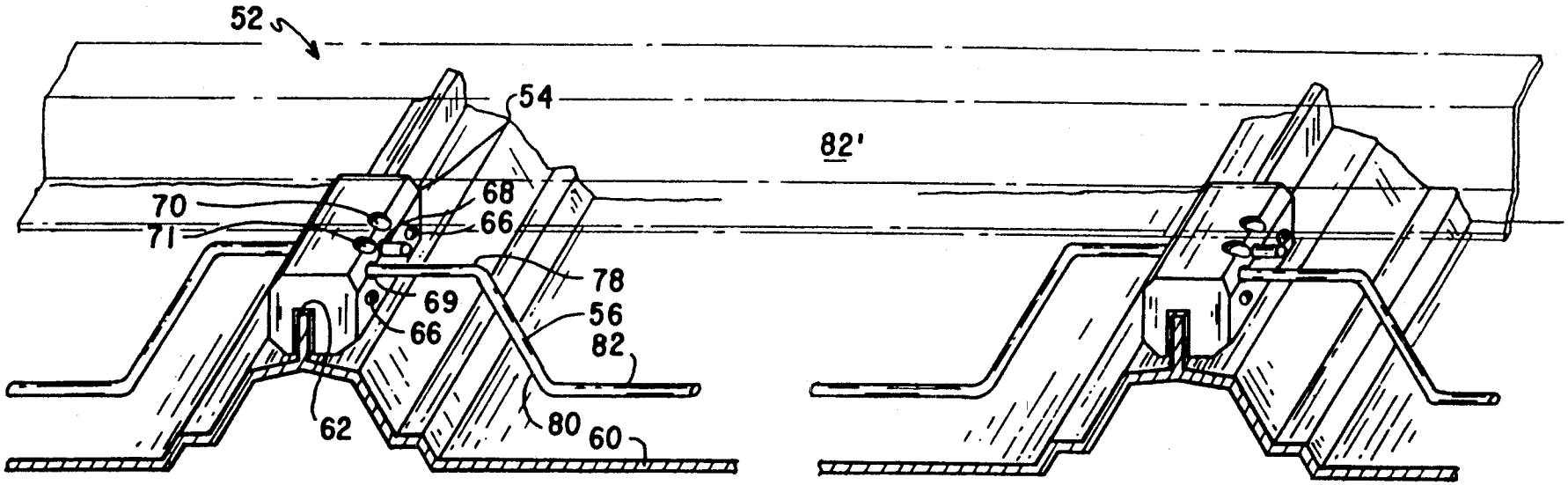
FIG. 5*b* is the apparatus of FIG. 5*a* with an additional cross-member of a first configuration utilized therewith.
Figure 5C:
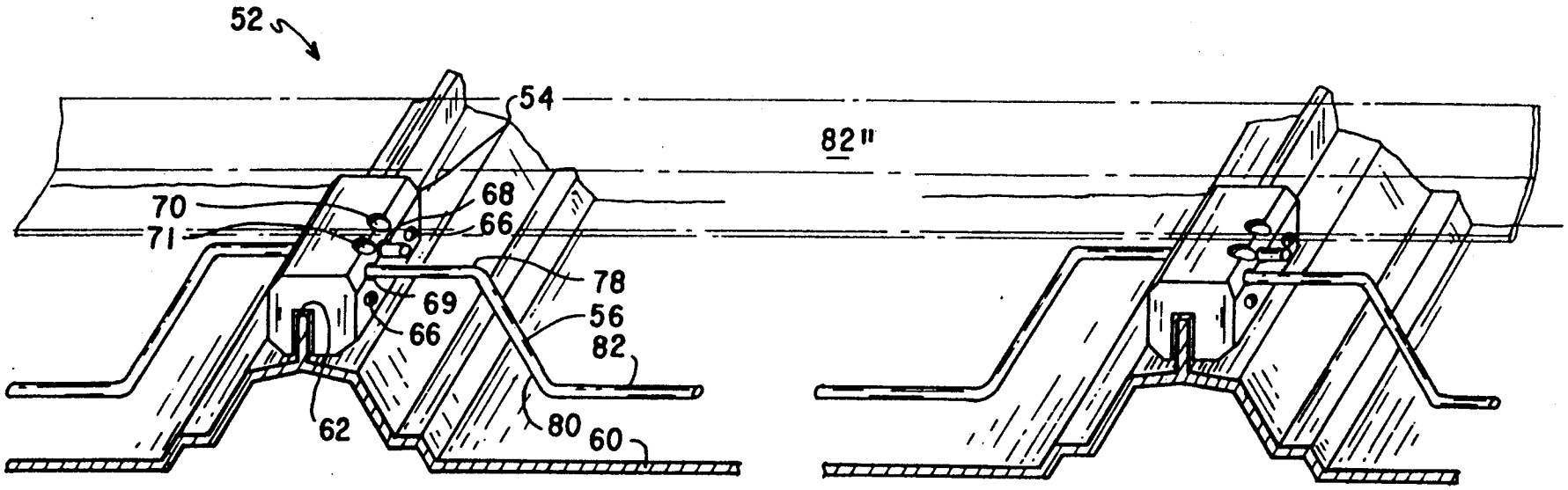
FIG. 5*c* is the apparatus of FIG. 5*a* with an additional cross-member of a second configuration utilized therewith.
Figure 6A:
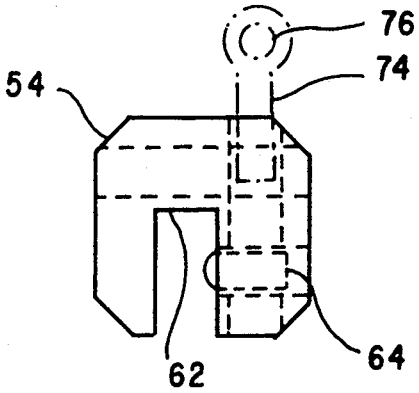
FIG. 6*a* is a front view of a clamp constructed in accordance with one embodiment of the present invention.
Figure 6B:
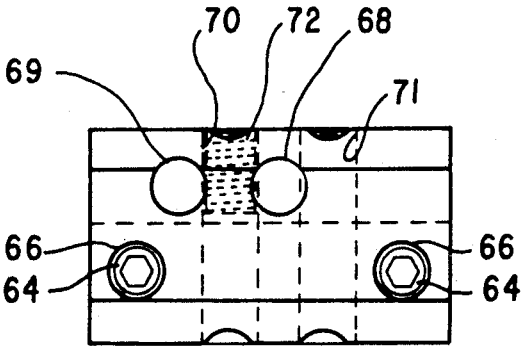
FIG. 6*b* is a right side view of the clamp of FIG. 6*a;*
Figure 6C:
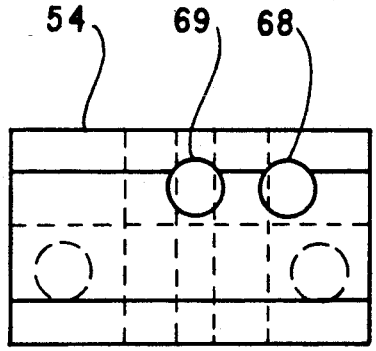
FIG. 6*c* is a left side view of the clamp of FIG. 6*a;*
Figure 6D:
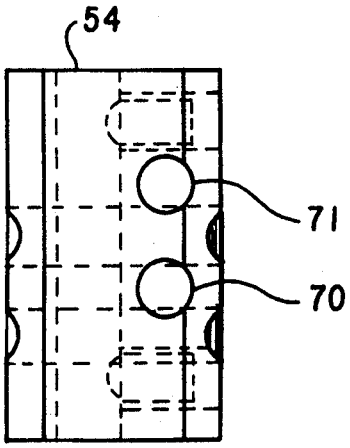
FIG. 6*d* is a top view of the clamp of FIG. 6*a;*
Figure 6E:
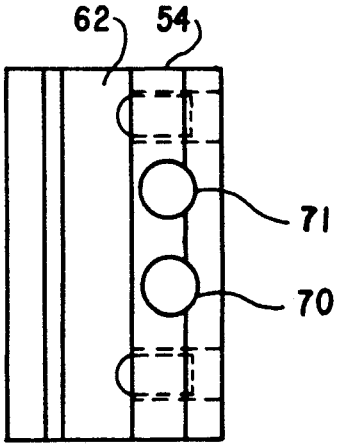
FIG. 6*e* is a bottom view of the clamp of FIG. 6*a;*

Referring to FIGS. 5–6*e*, an apparatus constructed in accordance with an alternative embodiment of the present invention is generally identified by the reference numeral 52. The apparatus 52 comprises a number of clamps 54 attached to ridges 55 (only two clamps 54 being required) and at least one cross-members 56 or 58 positioned above the roof 60 and between the adjacent clamps 54. The apparatus 52 is suitable for use in roofing applications similar to those described above, such as those formed by standing seam interconnections for adjacent panel sections.

The clamp 54 is similar in many respects to the clamp 12 described above. The clamp 54, which may be formed from anodized aluminum, is provided with a slot 62 to receive ridge 55. A pair of set screws 64 are threadably extendable from bores 66 into slot 62 to engage, without piercing, ridge 55. However, unlike the clamp 12 described above, the illustrated clamp 54 is adapted to simultaneously receive two laterally displaced cross-members 56 and 58.

The clamp 54 is adapted for use in either a vertical or a horizontal configuration as in the case of the clamp 12, although only the vertical orientation is illustrated in FIGS. 5*a*–5*c*. Referring to FIGS. 6*a*–6*e*, the clamp 54 is therefore provided with two side-to-side openings 68 and 69 for receiving cross-members 56 and 58 in the vertical configuration (i.e., with the slot 62 projecting down toward the roof 60 as illustrated in FIG. 5) and two top-to-bottom openings 70 and 71 for receiving cross-members 56 and 58 in the horizontal configuration (i.e., with the slot 62 projecting substantially parallel to the roof 60 as shown by the clamp 12 in FIG. 4*a*). In the horizontal configuration, at least one of the side-to-side openings 68 and 69 can intersect at least one of the top-to-bottom openings 70 and 71 so that a set screw 72 can be inserted through the opening(s) 68 and/or 69 to positionally secure the cross-members 56 and 58 in the openings 70 and 71. Similarly, in the vertical configuration, set screw 72 can be inserted through at least one of the openings 70 and 71 to positionally secure the cross-members 56 and 58 within openings 68 and 69. In the illustrated embodiment, opening 68 intersects both openings 70 and 71, and opening 70 intersects both openings 68 and 69, such that a single set screw 72 can be used to secure both cross-members 56 and 58 in either the horizontal or the vertical configuration. Thus, the openings 68 and 70 can be partially threaded as shown. It will be appreciated that an eye bolt 74 (shown in phantom) can be used in place of set screw 72 to provide for an additional member 76 (phantom) if desired and/or to provide an alternative means for adjusting a distance between the roof 60 and the member 76 (i.e., by varying the length of the eye bolt 74). Moreover, a cross-member 82' of an L-shaped configuration and/or a cross-member 82" of a Z-shaped configuration, as well as other appropriate configurations, may be appropriately attached to the clamps 54 (e.g., by using a bolt (not shown) to threadably engage the associated clamp 54) as illustrated in FIGS. 5*b* and 5*c*, respectively.

Although the physical size of the clamp may be modified to accommodate for a given application, in one embodiment the clamp 54 has a height, h, of about 1.6 inches; a width, w, of about 1.6 inches; and a length, l, of about 2.5 inches. The slot 62 in this embodiment is about 0.9 inches deep and 0.4 inches wide. The openings 68, 69, 70 and 71 have a diameter of about ⅜ inch. Such dimensions have been found suitable for a broad range of roofing applications.

It may be desirable to be able to adjust the height of at least a portion of the cross-members 56 and 58 over the surface of the roof 60 to modify the control of snow and/or ice movement. Thus, for example, a variety of openings may be provided in clamp 54 to allow adjustment of the positioning of cross-members 56 and 58 (not shown), or the cross-members 56 and 58 can otherwise be attached to the clamp 54 at variable heights. In the illustrated embodiment, cross-members 56 and 58 are provided with bent shapes, defined by substantially horizontal end portions 78, sloping portions 80, and substantially horizontal central portions 82, such that the height of the central portion 82 relative to the surface of the roof 60 can be varied by pivoting or rotating member 56 relative to clamps 54. The height of the central portions 82 can thus be adjusted by pivoting or rotating members 56 and 58 until the desired height is achieved and then tightening the set screw 72 to secure the members 56 and 58 in the selected position. In this manner, the height of the central portions 82 can be steplessly adjusted across a broad range of heights. In addition, the central portions 82 can be positioned at heights lower than the clamps 54 as shown, such that portions 82 can be positioned close to the surface of the roof 60, as may be desired, even where the clamps 54 are attached to relatively tall ridges.

Figure 7:
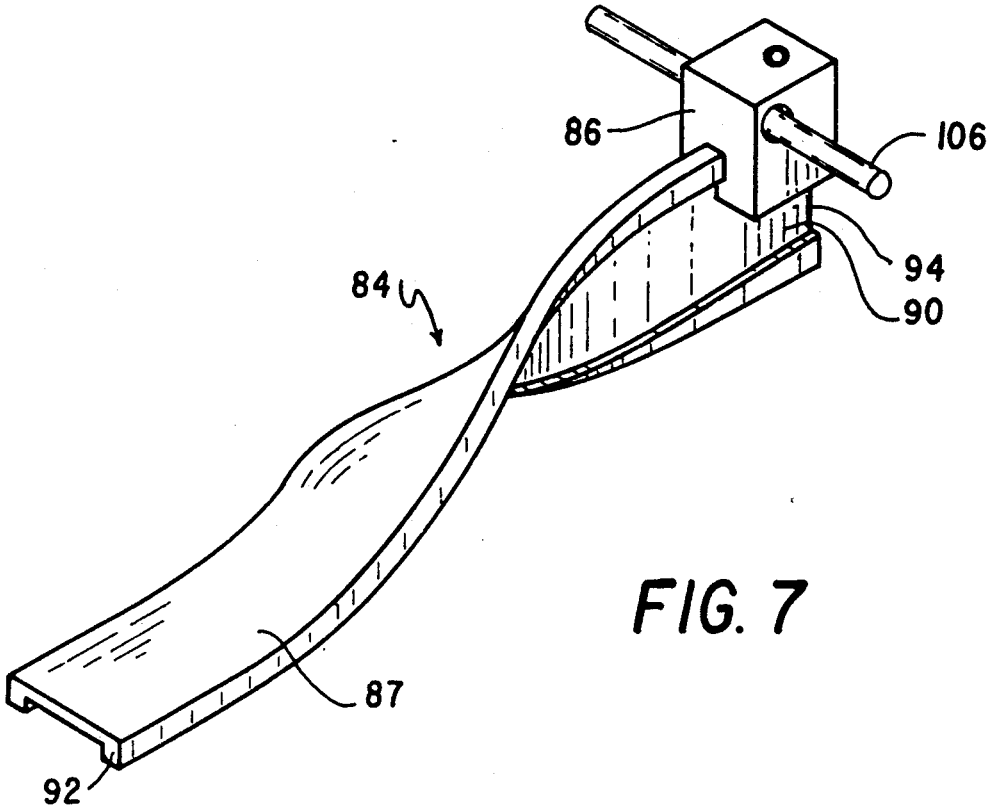
FIG. 7 is a perspective view of an adapter and clamp constructed in accordance with another embodiment of the present invention.
Figure 8:
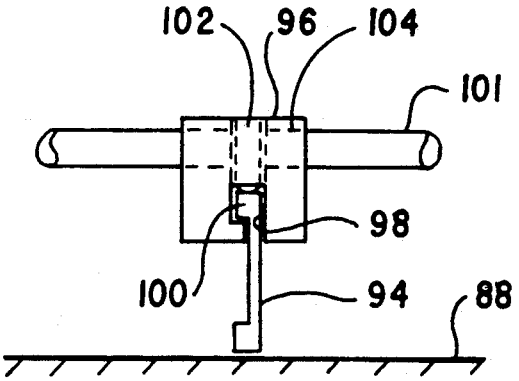
FIG. 8 is a front view of the adapter and clamp of FIG. 7.

Referring to FIGS. 7 and 8, an adaptor constructed in accordance with the present invention is generally identified by the reference numeral 84. The adaptor can be utilized to allow attachment of a clamp 86 to, for instance, a roof 88 where a ridge is not present. The adaptor 84 comprises a securement portion 87 which lies prone on the roof 88 and a second, raised portion 90 which functions analogously to the ridges/standing seams in the above-described embodiments to provide a surface for attachment of the clamp 86. In this regard, the adaptor 84 can have a right angle cross-section, e.g., a generally T-shaped or L-shaped cross section, including a base portion for securement to the roof 88 and an upwardly projecting portion. In the illustrated embodiment, the adaptor 82 comprises a twisted aluminum strip having a first, substantially horizontal end 92 and a second, substantially vertical end 94.

The clamp 86 can comprise an aluminum body 96 having a slot 98 therein for receiving the raised portion 90 of adaptor 84. The slot 98 and raised portion 90 can be provided with complementary shapes. As shown, the slot 98 has a generally "L" shaped cross-section to receive a flanged portion 100 of the adaptor 84. A blunt nosed set screw 102 can be inserted through clamp 86 to frictionally engage the adaptor 84, thereby securing the clamp 86 thereto. The clamp 86 is further provided with an opening 104 for receiving a cross-member 106 such as described above. The clamp 86 can thus be used to position the member 106 on the roof 88 by attaching the securement portion 87 to the roof 88, e.g., by using an adhesive, nails, screws or the like; securing the clamp 86 to the raised portion 90 of the adaptor 84; and sliding the cross-member 106 through opening 104 of the adaptor 84. Although the clamp 86 has been described as such, this alternative installation method may be used with configurations of clamps as described above.

Those skilled in the art will appreciate that various modifications and adaptations of the described embodiments of the present invention are possible. For example, the various clamps described above may be used in connection with applications other than the snow or ice blocking applications described above. Thus, the clamps can be utilized to attach walkways, guy wires, worker safety lines, signs or other building components to a roof, wall or the like having a raised portion, such as by utilizing one or more of the described types of openings (preferably being threaded within the respective clamp). For instance, the described eye bolts 48 may be positioned on the clamp 12 to be used as a guy wire or the like, either alone or in combination with the controlled movement of snow and/or ice provided by the cross-member 18. In addition, the snow or ice blocking members described above may be provided as hollow tubes containing a heater element to melt snow or ice on roofs.

Although the present invention has been described with respect to specific embodiments thereof, various changes and modifications, in addition to those cited above, may be suggested to one skilled in the art and it is intended that the present invention encompass such changes and modifications as fall within the scope of the appended claims.

What is claimed is:

1. An apparatus for controlling movement of ice and/or snow along a predetermined area of a sloping surface, said surface including a plurality of spaced, longitudinal raised portions, said raised portions extending from an elevated portion of said surface to a lower portion thereof and each being laterally separated by a base portion, wherein said raised portions are positioned a greater distance above a reference plane than said base portions, said apparatus comprising:

clamp means for detachably engaging one of said raised portions, said clamp means including a body having a longitudinal cavity for receiving said one raised portion and means for frictionally engaging an external surface of said one raised portion, said means for frictionally engaging comprising at least one blunt-nosed screw threadably interconnected to said body, said screw being extendable into said cavity to deform said external surface of said one raised portion, wherein a first of said clamp means is positionable on a first of said raised portions and a second of said clamp means is positionable on a second of said raised portions; and a cross-member interconnectable with said clamp means, wherein a first said cross-member extends between and is interconnected with said first and second clamp means above at least one of said base portions.

2. The apparatus of claim 1, wherein said blunt-nosed screw is substantially free from interaction with an internal portion of said one raised portion.

3. The apparatus of claim 1, wherein said means for frictionally engaging only engages said external surface of said one raised portion.

4. The apparatus of claim wherein said body comprises an opening to slidably receive said cross-member therein.

5. The apparatus of claim 1, wherein said cavity extends from a front end to a back end of said body and wherein said body further comprises first and second openings, said first opening extending from a left to a right end of said body and adapted to receive said cross-member therein when said clamp means is in a first orientation on said one raised portion, said second opening extending from a top end to a bottom end of said body and adapted to receive said cross-member therein when said clamp means is in a second orientation on said one raised portion.

6. The apparatus of claim 1, wherein a third of said clamp means is positionable on a third of said raised portions, said second camp means being positionable between said first and third clamp means, and further comprising a second said cross-member extending between and interconnected with said second and third clamp means above at least one of said base portions.

7. The apparatus of claim 6, wherein said body of said second clamp means further comprises first and second openings for receiving said first and second cross-members, respectively, therein.

8. The apparatus of claim 7, further comprising means for securing said first and second cross-members in a predetermined positioned, said means for securing simultaneously interacting with each of said first and second openings.

9. The apparatus of claim 1, wherein said cross-member is detachably interconnected to said body.

10. The apparatus of claim 1, wherein said first cross-member comprises a substantially straight rod.

11. The apparatus of claim 1, wherein said first cross-member comprises first and second end portions and an intermediate portion which is offset relative to said end portions.

12. The apparatus of claim 11, further comprising means for pivoting said first cross-member into a predetermined position to vary a distance between said intermediate portion of said first cross-member and said at least one base portion.

13. The apparatus of claim 1, further comprising means for securing said cross-member to said body of said clamp means.

14. The apparatus of claim 1, further comprising first and second extension means detachably connected to said first and second clamp means, respectively, for directly engaging said first cross-member, wheiein said first and second extension means allows for increasing a distance between at least a portion of said first cross-member and said at least one base portion.

15. An apparatus for controlling movement of snow and/or ice along a predetermined area of a sloping surface having at least two raised portions and at least one body portion positioned therebetween, said raised portions being positioned a greater distance above a reference plane than said at least one body portion, said apparatus comprising:

first clamp means for engaging a first of said raised portions and second clamp means for engaging a second of said raised portions, a first said body portion being positioned between said first and second raised portions;

a first cross-member supported by and extending between said first and second clamp means above said first body portion, wherein said first cross-member is positioned within first and second receiving portions of said first and second clamping means, respectively, said first cross-member comprising a rod having first and second end portions and an intermediate portion positioned between and interconnecting said first and second end portions, said first and second end portions interacting with said first and second receiving portions, respectively, said first and second end portions each being offset from said intermediate portion; and means for adjusting a distance between at least a portion of said first cross-member and said first body portion of said surface, said first cross-member being retained within said first and second receiving portions, said means for adjusting comprising means for pivoting said rod about said first and second end portions to adjust a distance between said intermediate portion and said first body portion of said surface.

16. The apparatus of claim 15, further comprising a third clamp means for engaging a third of said raised portions, said second clamp means being positionable between said first and third clamp means, a second said body portion being positioned between said second and third raised portions, a second cross-member being supported by and extending between said second and third clamp means above said second body portion, wherein said second cross-member is positioned within third and fourth receiving portions in said second and third clamp means, respectively, and means for adjusting a distance between at least a portion of said second cross-member and said second body portion.

17. The apparatus of claim 16, wherein said cross-member comprises a rod having first and second end portions and an intermediate portion positioned between and interconnecting said first and second end portions, said first and second end portions of said second cross-member interacting with said third and fourth receiving portions, respectively, said first and second end portions of said second cross-member each being offset from said intermediate portion, wherein said means for adjusting said second cross-member comprises means for pivoting said second cross-member about said first and second end portions.

18. The apparatus of claim 17, further comprising means for retaining said first and second cross-members in a fixed position, said means for retaining being positioned on said second clamp means and simultaneously interacting with each of said second and third receiving portions.

19. The apparatus of claim 15, wherein said first and second clamp means engage said first and second raised portions by frictionally contacting only external surfaces thereof.

20. An apparatus for controlling movement of ice and/or snow along a predetermined area of a sloping surface, said surface including a plurality of spaced, longitudinal raised portions, said raised portions extending from an elevated portion of said surface to a lower portion thereof and each being laterally separated by a base portion, wherein said raised portions are positioned a greater distance above a reference plane than said base portions, said apparatus comprising:

clamp means for detachably engaging one of said raised portions, said clamp means including a body having a longitudinal cavity for receiving said one raised portion and means for frictionally engaging an external surface of said one raised portion, wherein a first of said clamp means is positionable on a first of said raised portions and a second of said clamp means is positionable on a second of said raised portions, wherein said cavity of said clamp means extends from a front end to a back end of said body and wherein said body further comprises first and second openings; and a cross-member interconnectable with said clamp means, wherein a first said cross-member extends between and is interconnected with said first and second clamp means above at least one of said base portions, said first opening of said clamp means extending from a left to a right end of said body and adapted to receive said cross-member therein when said clamp means is in a first orientation on said one raised portion, said second opening of said clamp means extending from a top end to a bottom end of said body and adapted to receive said cross-member therein when said clamp means is in a second orientation on said one raised portion.

21. An apparatus for controlling movement of ice and/or snow along a predetermined area of a sloping surface, said surface including a plurality of spaced, longitudinal raised portions, said raised portions extending from an elevated portion of said surface to a lower portion thereof and each being laterally separated by a base portion, wherein said raised portions are positioned a greater distance above a reference plane than said base portions, said apparatus comprising:

clamp means for detachably engaging one of said raised portions, said clamp means including a body having a longitudinal cavity for receiving said one raised portion and means for frictionally engaging an external surface of said one raised portion, wherein a first of said clamp means is positionable on a first of said raised portions, a second of said clamp means is positionable on a second of said raised portions, and a third of said clamp means is positionable on a third of said raised portions, said second clamp means being positionable between said first and third clamp means, wherein said body of said second clamp means further comprises first and second openings;

a cross-member interconnectable with said clamp means, wherein a first said cross-member extends between and is interconnected with said first and second clamp means above at least one of said base portions, and wherein a second said cross-member extends between and is interconnected with said second and third clamp means above at least one of said base portions, said first and second openings of said second clamp means receiving said first and second cross-members, respectively; and means for securing said first and second cross-members in a predetermined positioned, said means for securing simultaneously interacting with each of said first and second openings of said second clamp means.

22. An apparatus for controlling movement of ice and/or snow along a predetermined area of a sloping surface, said surface including a plurality of spaced, longitudinal raised portions, said raised portions extending from an elevated portion of said surface to a lower portion thereof and each being laterally separated by a base portion, wherein said raised portions are positioned a greater distance above a reference plane than said base portions, said apparatus comprising:

clamp means for detachably engaging one of said raised portions, said clamp means including a body having a longitudinal cavity for receiving said one raised portion and means for frictionally engaging an external surface of said one raised portion, wherein a first of said clamp means is positionable on a first of said raised portions and a second of said clamp means is positionable on a second of said raised portions;

a cross-member interconnectable with said clamp means, wherein a first said cross-member extends between and is interconnected with said first and second clamp means above at least one of said base portions, wherein said first cross-member comprises first and second end portions and an intermediate portion which is offset relative to said end portions; and means for pivoting said first cross-member into a predetermined position to vary a distance between said intermediate portion of said first cross-member and said at least one base portion.

* * * * *